United States Patent [19]

Olson et al.

[11] 4,448,651

[45] May 15, 1984

[54] PROCESS FOR PRODUCING SILICON

[75] Inventors: Jerry M. Olson, Lakewood; Karen L. Carleton, Boulder, both of Colo.

[73] Assignee: The United States of America as represented by the United States Department of Energy, Washington, D.C.

[21] Appl. No.: 387,115

[22] Filed: Jun. 10, 1982

[51] Int. Cl.[3] ..... C25B 1/00; C25C 7/00

[52] U.S. Cl. ..... 204/60; 204/243 R; 136/258; 136/261

[58] Field of Search ..... 204/60, 145 F, 243 R, 204/293, 246

[56] References Cited

U.S. PATENT DOCUMENTS 800,984 10/1905 Chance ..... 204/60

3,219,561 11/1965 Monnier et al. ..... 204/60

3,254,010 5/1966 Monnier et al. ..... 204/60

3,983,012 9/1976 Cohen ..... 204/15

*Primary Examiner*—Howard S. Williams

*Assistant Examiner*—T. Williams

*Attorney, Agent, or Firm*—Kenneth L. Richardson; Sandra B. Weiss; Michael F. Esposito

[57] ABSTRACT

A process for producing silicon includes forming an alloy of copper and silicon and positioning the alloy in a dried, molten salt electrolyte to form a solid anode structure therein. An electrically conductive cathode is placed in the electrolyte for plating silicon thereon. The electrolyte is then purified to remove dissolved oxides. Finally, an electrical potential is applied between the anode and cathode in an amount sufficient to form substantially pure silicon on the cathode in the form of substantially dense, coherent deposits.

24 Claims, No Drawings

PROCESS FOR PRODUCING SILICON

CONTRACTUAL ORIGIN OF THE INVENTION

The U.S. Government has rights in this invention pursuant to Contract No. EG-77-C-01-4042 between the U.S. Department of Energy and the Midwest Research Institute.

BACKGROUND OF THE INVENTION

1. Field of the Invention

This invention relates to silicon production and more particularly to processes for producing high purity silicon. Specifically, this invention relates to a process for refining impure silicon, such as metallurgical grade silicon, to form sheets of high purity silicon usable in photovoltaic solar cells and the like.

2. Description of the Prior Art

High purity silicon is both useful and oftentimes required for a wide variety of industrial applications. One such application is in the area of photovoltaic solar cells. In such photovoltaic cells, thin sheets or wafers of highly refined silicon form at least the upper surface of a multi-layered cell adapted for direct conversion of incident solar radiation to an electrical potential. To date, the processes and techniques available to produce high purity silicon and to subsequently form such silicon into thin sheets or wafers are exxtremely expensive.

One commonly used technique for electrochemically purifying silicon is an adaptation of a well-known aluminum refining process. In this technique, silicon is substituted for aluminum to provide an electrochemical process utilizing a molten Cu/Si anode with Na based molten electrolyte. The electrolyte contains $Na_3AlF_6$ for transporting silicon to a cathode. An example of such a process is disclosed in the French paper by R. Monnier and J. C. Giacometti entitled, "Recherches sur la Raffinage Electrolytique du Silicium", Helvetica Chimica Acta, Vol. 47,345, (1964).

There are several significant problems with the above described type of system. One such problem is that since the anode must be molten, only a single electrode pair per electrochemical cell can be utilized. Therefore, silicon deposition per unit cell volume on the cathode proceeds rather slowly. Furthermore, due to the dynamics of such cells, large electrolyte vapor losses result from the high cell operating temperatures. Consequently, this particular system is not very economical.

Another known electrochemical process for plating Si is described in a paper by Uri Cohen entitled, "Some Prospective Applications of Silicon Electrodeposition from Molten Fluorides to Solar Cell Fabrication", J. Electronic Mat'ls, Vol. 6, #6, 607 (1977). In this particular process, a LiF, KF, $K_2SiF_6$ molten salt electrolyte is used to plate silicon onto a graphite cathode. However, a substantially pure solid sheet Si anode is required. Thus, this technique has no practical application for use with metallurgical grade or other impure silicon.

Other techniques presently being utilized to produce highly pure silicon for the semiconductor and photovoltaic industries include well known distillation processes as well as various chemical conversion techniques. However, all of these techniques are rather expensive to operate in order to produce sufficient quantities of highly pure or refined silicon. Therefore, there is a definite need for an economical process for producing highly refined silicon from metallurgical grade or other impure silicon.

Once highly refined silicon is produced, it must then be formed into thin sheets or wafers to be useful in the photovoltaic industry. The presently available processes for wafer or sheet formation are themselves very expensive to operate. Two common techniques for forming sheets of silicon are rolling and casting. One disadvantage with most rolling techniques is that silicon can only be rolled near its 1400° C. melting point, and this temperature is generally too high for fine rolling at production rates. Furthermore, the resultant silicon tends to be very brittle. A major difficulty with casting techniques, which are more frequently used, is that molten silicon reacts with most materials to some degree. Therefore, molds containing molten silicon are very expensive, and some of the silicon is lost due to removal of those portions of the casted silicon containing impurities from the mold casing.

A third commonly used technique for forming sheets of silicon comprises the cutting of sheets or wafers from solid blocks of silicon. However, such Si sheets must be very thin, and this feature results in a great deal of waste (up to 50%) in the form of silicon sawdust. This waste of highly pure silicon is, obviously, very uneconomical.

One of the major problems and hurdles facing the photovoltaic solar cell industry is in reducing the costs associated with producing photovoltaic cells. Efficient photovoltaic cells utilizing silicon are in fact presently available and could readily be utilized on a mass basis if it were not for a prohibitive pricing structure. Much of this pricing structure is a direct result of the high cost of purifying silicon and forming such purified silicon into thin wafers or sheets. The present invention meets both these needs of the photovoltaic industry by providing highly refined silicon at an economical cost as well a providing such highly refined silicon in sheet form at no substantial additional cost.

SUMMARY OF THE INVENTION

Therefore, it is one object of the present invention to provide a process for producing high purity silicon.

It is another object of the present invention to provide a process for refining metallurgical grade silicon into highly pure silicon capable of use in photovoltaic solar cells.

It is yet another object of the present invention to provide a process and electrochemical cell for producing substantially planar sheets of high purity silicon for use in photovoltaic solar cells.

In accordance with the invention, a process is provided for producing silicon which includes forming an alloy composed of copper and silicon. This alloy is positioned in a dried, molten salt electrolyte to form a solid, Cu/Si anode structure therein. An electrically conductive cathode is placed in the electrolyte for plating silicon thereon, and the electrolyte is then purified by removing dissolved oxides therefrom. Finally, an electrical potential is applied between the anode and cathode in an amount sufficient to form substantially pure silicon on the cathode in the form of substantially dense, coherent deposits.

In one preferred form of the invention, the Cu/Si alloy anode is maintained in its solid form by maintaining the molten salt electrolyte at a temperature below the eutectic temperature of the alloy. In addition, the cathode may include a substantially planar surface for the plating of highly pure silicon sheets thereon.

The novel features which are believed to be characteristic of the present invention are set forth in the appended claims. The invention itself, however, together with further objects and attendant advantages thereof, will become apparent and best understood by reference to the following detailed description, setting forth by way of illustration and example certain embodiments of the invention.

DETAILED DESCRIPTION OF THE PREFERRED EMBODIMENTS

In accordance with a preferred embodiment of the invention, a process for producing high purity silicon from unrefined silicon is provided. The unrefined silicon may be in the form of metallurgical grade silicon, which is approximately 98% pure, or in numerous other impure forms. The unrefined silicon is first combined with copper to form a Cu/Si alloy. This alloy is then formed into an anode structure having appropriate eletrical leads in accordance with well known techniques and is placed in an electrochemical cell of typical known design which contains a molten salt electrolyte and a cathode preferably inert to silicon. It is a critical aspect of this invention that the Cu/Si anode remain in solid form during cell operation to obtain a greater purification effect and to permit lower cell operating temperatures.

The electrochemical cell is first purged of dissolved oxides and then operated at an electrical potential such that the silicon diffuses through the solid Cu/Si anode, is transported by the electrolyte, and is then deposited onto the cathode in the form of highly refined silicon. The impurities present in the unrefined silicon are retained in the anode. The cathode structure may be in the form of a flat or planar surface to permit silicon deposition in the form of highly refined silicon sheets.

More specifically, the Cu/Si alloy preferably has the general two phase formula Si: $Cu_{3+x}Si_{1-x}$, wherein x is generally less than about 0.1. The preferred alloy species comprises $Cu_3Si$ in the form of a defect solid which includes a plurality of silicon crystallites interspersed throughout the $Cu_3Si$ structure. This alloy may be formed separately and then placed into the electrolyte, or it may be actually formed within the electrolyte environment used in the electrochemical cell of the present invention.

In either case, a mixture of the copper and metallurgical grade silicon is heated to a temperature greater than about 802° C., which is the eutectic temperature of the Cu/Si alloy. The greater the percentage of Si in the mixture and resultant alloy, the higher the liquidus temperature of the alloy mixture. Once the molten alloy is thoroughly mixed, it is gradually cooled to form a solid structure which has the general chemical formula $Cu_{3+x}Si_{1-x}$. This defect solid has small crystal-like structures or crystallites of impure silicon randomly interspersed throughout its lattice structure.

The exact amounts of copper and impure silicon used prior to melting and mixing are generally not particularly important. However, no more than about 30 wt. percent Si can be utilized in order to maintain the alloy liquidus temperature within a reasonable limit of about 1000°-1100° C. during the anode casting process. The reason that the actual ratio of copper to silicon is unimportant is that the $Cu_{3+x}Si_{1-x}$ defect solid structure with Si crystallites imbedded therein will always be formed when a molten mixture Cu/Si is cooled to below 802° C., the Si: $Cu_{3+x}Si_{1-x}$ phases being in equilibrium.

While the manner in which the Cu/Si anode functions in the electrochemical cell of the invention is not specifically known, it is believed that silicon from the silicon crystallites, as well as the alloy itself once the silicon crystallites are depleted, diffuses through the solid anode structure. This is believed possible due to the fact that the anode structure is a defect solid, and the openings in its lattice structure apparently permit solid state diffusion therethrough. However, the silicon impurities do not diffuse through the anode but rather are apparently retained in the alloy structure.

The selection of molten salts to form the electrolyte of the present invention may be made from any appropriate salt mixture capable of transporting silicon from the anode to the cathode. The preferred electrolyte comprises a mixture of LiF, KF and $K_2SiF_6$. However, one alternative molten salt mixture comprises LiF, CsF and $Cs_2SiF_6$. Compared to the potassium system, the cesium system is slightly more expensive and hydroscopic, but it has a lower vapor pressure thereby reducing losses during operation of the electrochemical cell. Nonetheless, any molten salt mixture which contains $SiF_6^{-2}$ anions for transporting silicon is preferred, and the most effective system appears to be the LiF, KF, $K_2SiF_6$ mixture.

In the preferred embodiment, the LiF:KF ratio is preferably approximately 1:1, with the actual mole percentage varying depending on the mole percentage of the $K_2SiF_6$. The mole percentage of the $K_2SiF_6$ is preferably 6–40 mole percent (m/o). It has been determined that if the $K_2SiF_6$ mole percent is less than about 6 m/o, the resultant silicon formed on the cathode is generally fibrous rather than being compact and dense, the latter form being preferred.

This undesirable fibrous formation is generally dendritic and tends to grow outwardly from the cathode to eventually short out the electrochemical cell if allowed to interconnect the electrodes. As a result, the electrode interface breaks down too quickly if the dendritic form of silicon is permitted to develop. Furthermore, since it is desirable to form flat sheets of silicon, dendritic growth is contrary to this and therefore highly undesirable. It has been found that the greater the mole percent of the $K_2SiF_6$ above about 6 m/o, the more compact and dense and the better (i.e., less dendritic) the silicon deposits become up to approximately 40 m/o.

When preparing the above described preferred electrolyte, commercially available $K_2SiF_6$ may be utilized if first purified, for standard $K_2SiF_6$ is generally only 98–99% pure. However, such purification techniques are somewhat complicated, making it difficult to purify $K_2SiF_6$, and on a commercial basis mass purification of $K_2SiF_6$ would be undesirably cumbersome and expensive. It has been discovered, however, that if the appropriate molten Li:Kf mixture with an excess of KF is first prepared and then exposed to $SiF_4$ gas, a reaction will take place to form $K_2SiF_6$ in the LiF:KF molten mixture. The $SiF_4$ gas may be bubbled through or just passed over the LiF:KF mixture. Thus, the requisite $K_2SiF_6$ may be synthesized in situ, thereby eliminating the purification step of commercial $K_2SiF_6$ and providing a single, inexpensive technique for manufacturing the preferred electrolyte mixture. This particular technique for admixing the LiF, KF, $K_2SiF_6$ electrolyte was utilized in Examples II and V described below.

A critical feature of the present invention is that the molten salt electrolyte be substantially free of dissolved oxides, and in particular dissolved metal oxides, prior to the plating of silicon on the cathode. Otherwise, such dissolved oxides inhibit the growth of dense, coherent silicon films on the cathode. The first step in purifying or purging the electrolyte of such dissolved oxides occurs prior to formation or placement of the anode in the molten salt electrolyte. Once the electrolyte is mixed as described above, it is then dried at an elevated temperature preferably under a vacuum. This dries the hydroscopic electrolyte and prevents the formation of hydrolysis products. While any standard or known drying technique may be utilized with or without a slight vacuum, the preferred method includes drying the electrolyte for several days at approximately 200° C. under a $5\times10^{-6}$ torr vacuum. The remaining or second step in purging the electrolyte of dissolved oxides occurs as a subsequent step of the invention as described below.

The Cu/Si alloy, as previously mentioned, may be formed separately or it may be formed in the electrolytic environment. To form the alloy in the electrolytic environment, a mixture of copper and metallurgical grade silicon, as described above, is added to the molten salt electrolyte after the electrolyte has been dried. The electrolyte is then heated to a temperature greater than the liquidus temperature of the alloy, which temperature will vary depending on the Cu:Si ratio. After so heating the electrolyte, the copper and silicon, aided by the fluxing action of the molten salt electrolyte, reacts to form the molten Cu/Si alloy. Since the alloy and the electrolyte are immiscible, the electrolyte floats on top of the heavier, denser molten alloy. The electrolyte is then cooled to a temperature below the eutectic temperature of the alloy, and preferably to approximately 790° C., at which point the Cu/Si alloy solidifies to form a solid anode structure. It is an important aspect of the present invention that the anode structure be solid in form rather than in a molten state, since impurities are trapped in the solid state lattice structure of the anode in the present invention. Furthermore, the solid state alloy permits the electrochemical cell to be operated at a substantially lower temperature than prior art molten anode cells. This feature permits the operation of the present cell to be less expensive and more efficient.

Once the Cu/Si alloy is formed and positioned with appropriate electrical leads within the dried, molten salt electrolyte, an electrically conductive cathode of any well known design is then positioned within the electrolyte and spaced appropriately from the anode. The cathode may comprise any appropriate material which is electrically conductive and preferably chemically inert to silicon and the electrolyte. Examples of such materials include vitreous carbon, single crystal silicon, graphite and the like. A preferred material is POCO graphite, a trademark graphite material manufactured by Union Carbide. The cathode is preferably in the form of a flat plate to provide a planar surface for plating of the silicon in the form of long, coherent dense sheets. Such sheets of silicon are directly usable in photovoltaic or semiconductor cells as previously described above.

It is generally desired to produce highly refined silicon per se for subsequent use in a photovoltaic cell or the like. In this instance, the formed silicon must be capable of being readily removed from the cathode structure after its formation. The material selected for the cathode structure must, therefore, be adapted to permit ready release of the silicon after its formation and removal from the electrochemical cell. Graphite, vitreous carbon, and similar materials will perform such a function. Moreover, KF, LiF, and the like act as a mold release agent for silicon from a graphite cathode base.

There are instances, however, when it is desired to form silicon sheets on a substrate material, such as metal, for subsequent use in combination therewith. If such a combined end use is desired, the silicon can first be formed and then attached to the metal substrate, or the silicon itself can be plated directly onto the metal substrate. In the latter instance, the cathode structure of the present electrochemical cell is selected to serve as the metal substrate such as stainless steel, tungsten, molybdenum and the like. When such metal cathode structures are selected, the highly pure silicon adheres firmly thereto when it is formed along its surface.

Once the anode and cathode are positioned in the molten electrolyte with appropriate leads being attached for applying an electrical potential, the second phase of purifying or purging the electrolyte of dissolved oxides is then effectuated. To complete the purging or purifying, a pre-electrolysis using a reverse electrical potential is used. More specifically, a reverse potential is applied so as to polarize the Cu/Si alloy cathodically, the reverse potential being of sufficient magnitude to substantially remove any remaining dissolved oxides, and in particular dissolved metal oxides, from the molten electrolyte. It is preferred that the cell's reverse potential be at least approximately 2 volts. In this manner, dissolved metal carbons are transported to the Cu/Si alloy and incorporated therein, thereby removing them from the electrolyte, while oxygen is evolved from the electrolyte.

Once the electrolyte is purged of dissolved oxides, the electrochemical cell is ready for operation to deposit high purity silicon on the cathode. To achieve such deposition, a direct potential is applied to the cell to polarize the graphite or other cathode material cathodically. Generally, since silicon is highly electropositive, very small cell potentials in the order of 25–300 mV are sufficient to transport silicon from the Cu/Si anode to the cathode.

In the preferred embodiment, the actual electrical potential applied to the electrochemical cell is applied in variable amounts in order to maintain a constant current density. The preferred current density is in the range of about 25–200 mA/cm$^2$. Current densities of up to 200 mA/cm$^2$ have yielded dense, coherent silicon deposits. However, at such very high current densities, the thickness of the Si deposits are generally limited to about 100 $\mu$m. If thicker silicon deposits on the cathode are obtained at such high current densities, the growth morphology of the silicon becomes dendritic or botryoidal, which is undesirable. Also, the grain size of the silicon deposit is an inverse function of the current density applied to the cell, with about 200–400$\mu$ grains of dense, coherent Si being obtainable at a current density of about 40–50 mA/cm$^2$.

There is, however, a maximum critical level of current density above which silicon will be produced in dendritic form, and this maximum current density depends upon, inter alia, the duration of cell operation, the thickness of the silicon deposit, and the molecular percent of the $SiF_6^{-2}$ anions in the electrolyte. In the above described molten salt system containing $K_2SiF_6$, it has been found that as the mole concentration of the $K_2SiF_6$ in the electrolyte was increased, the critical current density achievable with the cell also increased in direct proportion. Therefore, when the current density is maintained substantially constant, the electrical potential required to maintain such a constant current density is generally inversely proportional to the mole percent of the $K_2SiF_6$. Moreover, the maximum critical current density depends upon many other variables such as the temperature at which the cell is operated, the oxide impurities which in fact remain dissolved in the electrolyte, the electrode spacing, and the like. All of these factors will affect the maximum critical current density and are readily determinable for any particular circumstance without undue experimentation.

The purity of the refined silicon achieved by the present invention has been measured by spark source mass spectrometry. In general, the only elements present in the refined silicon in concentrations more than a few ppm are the elemental components of the electrolyte, in particular potassium, lithium and fluorine in the preferred embodiment. These electrolyte impurities can be removed by heating the silicon under a vacuum, or they may be retained in the Si if they would not affect the function of the device in which the Si is ultimately used.

Concentrations of the more important impurities to be removed from the impure silicon, such as aluminum, boron, titanium, iron, vanadium, chromium, tungsten, molybdenum, and copper, were extraordinarily low in the refined silicon produced by the present invention. The refined silicon so produced was determined to be 99.9995% pure. Concentrations of the above important impurities were extraordinarily low because the metallurgical grade silicon initially included about 2,500 ppm iron, 3,400 ppm aluminum, 17 ppm boron, and the like. Typical metal impurity concentrations in the metallurgical grade Si used to form refined Si are more specifically illustrated in Table I below. Such results were quite unexpected from electrorefining only. The actual processes occurring within the electrochemical cell that permitted such high purity silicon to be formed are uncertain. It is speculated, however, that perhaps diffusional trapping of the impurities by the solid Cu/Si alloy played a major role, as well as the purification expected from the electrorefining.

TABLE I

| Metal Impurity | Concentration (ppm) in Metallurgical Grade Si-Anode Structure | Concentration (ppm) in Refined Si Deposited on Cathode |
|---|---|---|
| Al | 3400.0 | 1.0 |
| B | 17.0 | 0.7 |
| Ba | 9.4 | <0.02 |
| Ca | 290.0 | <0.07 |
| Cu | — | 0.2 |
| Cr | 40.0 | <0.2 |
| Fe | >2500.0 | 0.1 |
| Mg | 85.0 | 0.9 |
| Mn | 550.0 | 0.03 |
| Mo | 1.4 | <0.03 |
| Ni | 39.0 | <0.1 |
| P | 14.5 | 3.0 |
| S | 7.0 | 0.4 |
| Ti | 290.0 | <0.1 |
| V | 250.0 | <0.05 |
| Zr | 13.0 | <0.03 |

While only simple electrochemical cell configurations were utilized in the examples described above and below, it is envisioned that large electrochemical cells having multiple sets of anodes and cathodes may be utilized in a large molten salt electrolyte bath. However, prior to the present invention, use of such multielectrode cells for refining silicon were out of the question because flat plate silicon was too difficult to fabricate, and multielectrode cells with molten anode were impracticable. However, due to the much lower melting point of the Cu/Si alloy of the present invention, the fabrication of a solid "silicon" anode becomes a relatively simple process.

The following examples are illustrative only of the cells constructed and ranges of materials usable in the present invention.

EXAMPLE I

An electrolytic cell in accordance with the invention was used to purify metallurgical grade silicon. A crucible container of vitreous carbon was utilized to hold the molten electrolyte and to also serve as the electrical contact to the Cu/Si anode. The cathode material was a high density, high purity graphite that had been degassed by subjecting it to a vacuum bakeout. The orientation of the cathode was horizontal or parallel to the Cu/Si anode.

Approximately 52 grams of electrolyte comprising 46 mole percent KF, 46 mole percent LiF, and 8 mole percent $K_2SiF_6$ were added to the above described crucible. This cell was then placed into a furnace where it was first dried at 200° C. and under $5\times10^{-6}$ torr for several days, and then fused to about 800° C.

This cell was then cooled at room temperature at which time 7.25 grams of metallurgical silicon and 37.75 grams of copper were added to the electrolyte. The cell was then heated to a temperature of about 820° C. at which point the copper and silicon reacted to form a molten Cu/Si alloy at the bottom of the cell. After alloy formation, the temperature was decreased to about 740° C. at which point the alloy was solid but the electrolyte was still molten. The electrolyte was then purified by a preelectrolysis at a reverse cell potential of about 2.0 volts until the cell current dropped to below 10 mA/cm$^2$. A number of separate silicon depositions onto the cathode at various current densities were then made from this cell as follows:

| Deposition | Current density (mA/cm$^2$) | Grain Size (μm) |
|---|---|---|
| A | 12 | unmeasured |
| B | 120 | unmeasured |
| C | 220 | unmeasured |
| D | 50 | ≦60 |
| E | 175 | ≦22 |

In all the above cases, the resultant silicon deposits were reasonably dense, coherent and compact, with a few bare areas (no silicon deposition) in the form of pinholes and bubble holes on the cathode surface.

EXAMPLE II

Another electrolytic cell in accordance with the invention was used to purify metallurgical grade silicon. This cell was similar to that of Example I, except for the following changes:

1. The electrolyte comprised 40 m/o LiF, 40 m/o KF, and 20 m/o $K_2SiF_6$;
2. The cathode comprised a thin foil POCO graphite;
3. The cathode was oriented vertically or perpendicular to the anode;

4. All the chemical components of the electrolyte and anode were dried, fused and purified simultaneously; and 5. The LiF, KF, $K_2SiF_6$ was prepared by passing gaseous $SiF_4$ over a 1:1 mixture of LiF:KF with excess KF as previously described in greater detail.

The following silicon deposition was then performed with this cell:

| Deposition # | Current density (mA/cm$^2$) | Average grain size (μm) |
|---|---|---|
| F | 30 | 110 |

In this particular case, the deposits were exceptionally dense and coherent with very few pinholes and similar defects. From this, it was inferred that the quantity of the silicon deposition will continue to improve with higher $K_2SiF_6$ concentration. A tradeoff exists, however, in that the fugacity of $SiF_4$ (the loss of $SiF_4$ gas from the electrolyte) increases with the $K_2SiF_6$ concentration. Therefore, there must be a point of diminising return. Otherwise, the expense of continual $K_2SiF_6$ addition to the cell becomes prohibitive.

In a similar manner, it is expected that the substitution of cesium for potassium in the electrolyte, as previously described, should have a beneficial effect on the morphology of the deposits and the thermal stability of the electrolyte, in that such an effect has been noted in scientific literature in connection with the electrowinning and electrorefining of transition metals in molten fluoride electrolytes.

EXAMPLE III

An electrochemical cell similar to Example I was assembled. However, the Cu/Si anode was formed such that it comprised a homogeneous $Cu_3Si$ solid phase without any silicon crystallites. This was achieved by depleting the crystallite phase of a nonhomogeneous $Cu_3Si$ defect solid anode prior to running the deposition tests indicated below. The following silicon deposition runs were then made:

| Deposition # | Current density (mA/cm$^2$) | Average grain size (μm) |
|---|---|---|
| G | 30 | 120 |
| H | 100 | 35 |

The deposition potential was a factor of about 2.5 greater than that in Examples I and II. Otherwise, the characteristics of the resultant Si deposits remained unchanged from the other Examples. However, based on these tests, a lower limit of Si concentration in the anode structure was determined to be about 10 weight percent.

EXAMPLE IV

An electrochemical cell similar to Example I was formed, except that the $K_2SiF_6$ concentration in the electrolyte ranged from 4–6 m/o with the LiF:KF ratio being about 1:1 for the balance of the electrolyte. Furthermore, the silicon deposition process was performed at a temperature of about 812° C. The resultant Si deposits were not as dense and coherent as the deposits of the previous Examples which operated at lower temperatures. In fact, the resultant deposits tended toward fibrous, dendritic deposits. It was also determined that the electrolyte had not been fully purged of dissolved oxides. It is believed that these oxides contributed toward the dendritic Si formations, and thus established the criticality of purging the electrolyte of substantially all dissolved oxides.

EXAMPLE V

An electrochemical cell similar to Example II ws formed. This cell was then operated in accordance with the process of the present invention except that the temperature of the cell was maintained above the eutectic temperature of the Cu/Si alloy during silicon deposition, resulting in a molten anode. Furthermore, in three of the four runs, the cathode comprised single crystal silicon rather than the standard planar graphite sheet. The following silicon deposition runs were made:

| Deposition # | Current density (mA/cm$^2$) | Cathode Substrate | Operating Temperature (°C.) |
|---|---|---|---|
| I | 20 | Single Crystal Si | 834 |
| J | 40 | Single Crystal Si | 824 |
| K | 20 | Graphite Sheet | 817 |
| L | 20 | Single Crystal Si | 812 |

Depositions I and J resulted in, respectively, partial and complete epitaxial Si coverage of the cathode substrate. Depositions K and L resulted in dendritic silicon formation, with $SiO_2$ being formed on the surface of the silicon deposits of run L. In general, the electrolyte tended to break down much easier at the elevated temperatures, and the metallurgical grade silicon's impurities were not retained in the anode. This latter result was concluded to be due to the molten state of the anode as opposed to the solid anode state in the previous examples.

EXAMPLE VI

To test the limits of purity attainable with the invention, another experiment was performed. An electrochemical cell similar to Example II was formed, except that semiconductor grade (highly pure) silicon (sg) was substituted for the metallurgical grade silicon (mg) in the copper-silicon alloy. The material deposited at the cathode was dense and coherent. In comparing chemical analyses (spark source spectrometry) of silicon electrorefined by this method from Si (mg) and from Si (sg) we found very little difference in the purity (see Table II). The exceptions were that the phospherous content was down by an order of magnitude, and the iron and nickel concentrations were higher when Si (sg) was used. This indicates that the major source of impurities in the electrodeposited silicon is not the copper silicon anode, but rather the electrolyte and/or the actual cell components. This indicates that the copper-silicon anode is indeed retaining impurities, and that the purity of the deposited material is not limited by the initial silicon purity in the anode structure.

TABLE II

Typical Impurity Analysis of Silicon Electrodeposited from sgSi and mgSi

| Metal Impurity | Si(sg) (ppma) | Si(mg) (ppma) |
|---|---|---|
| Al | 1.1 | 1.0 |
| B | 1.0 | 0.7 |

TABLE II-continued

| Typical Impurity Analysis of Silicon Electrodeposited from sgSi and mgSi | | |
|---|---|---|
| Metal Impurity | Si(sg) (ppma) | Si(mg) (ppma) |
| Ba | <0.02 | <0.02 |
| Ca | 0.11 | <0.07 |
| Cu | 0.08 | 0.2 |
| Cr | 0.12 | <0.2 |
| Fe | 1.5 | 0.1 |
| Mg | 0.19 | 0.9 |
| Mn | 0.16 | 0.03 |
| Mo | <0.03 | <0.03 |
| Ni | 0.6 | <0.1 |
| P | 0.33 | 3 |
| S | 0.35 | 0.4 |
| Ti | 0.33 | <0.1 |
| V | <0.05 | <0.05 |
| Zr | <0.03 | <0.03 |

As described above, the present invention provides a process of utilizing an electrochemical cell for producing highly refined silicon capable for use in the photovoltaic solar cell industry, semiconductor industry and the like. The present invention is relatively inexpensive and simple to operate, yet produces silicon of sufficiently high purity to permit direct use in photovoltaic cells. Furthermore, the process of the present invention permits the formation of high purity sheets of silicon without having to rely on prior expensive and inefficient sheet formation processes and techniques such as molding, casting, diamond cutting and the like. The process of the present invention also permits the use of multiple electrodes in a single electrolyte bath to form a plurality of Si sheets simultaneously, thereby permitting the formation of large amounts of silicon in a relatively short period of time. Thus, the process of the present invention is inexpensive, efficient, and requires no additional steps to produce high purity silicon for a multiplicity of uses.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein but may be modified within the scope of the appended claims.

The embodiments of the invention in which an exclusive property or privilege is claimed are defined as follows:

1. A process for producing silicon comprising:
forming an alloy of Cu and Si;
positioning said alloy in a dried, molten salt electrolyte to form a solid Cu/Si anode structure therein;
placing electrically conductive cathode means within said electrolyte for plating silicon thereon;
purifying said electrolyte to remove dissolved oxides therefrom; and
applying a potential between said anode and cathode means in an amount sufficient to form substantially pure silicon on said cathode means in the form of substantially dense, coherent deposits.

2. The process as described in claim 1, wherein said electrolyte comprises a mixture of molten salts containing $SiF_6^{-2}$ anions for transporting silicon to said cathode means.

3. The process as described in claim 2, wherein said electrolyte comprises a mixture of LiF, KF and $K_2SiF_6$.

4. The process as described in claim 3, wherein said electrolyte mixture is formed by exposing a molten mixture of LiF and KF having an excess of KF to gaseous $SiF_4$ to produce the $K_2SiF_6$ in the LiF, KF mixture.

5. The process as described in claim 3, wherein said LiF and KF are present in a mole percent ratio of approximately 1:1, and said electrolyte includes approximately 6 to 40 mole percent $K_2SiF_6$.

6. The process as described in claim 2, wherein said potential is applied in variable amounts sufficient to maintain a constant current density between said cathode means and anode and is inversely proportional to the mole percent of said $SiF_6^{-2}$ anions in said electrolyte.

7. The process as described in claim 1, wherein said Cu/Si alloy comprises an alloy of $Cu_{3+x}Si_{1-x}$, where x is less than about 0.1.

8. The process as described in claim 7, wherein said Cu/Si alloy comprises $Cu_3Si$ having silicon crystallites interspersed therethrough.

9. The process as described in claim 1, wherein the formation of said alloy and the placing thereof in said electrolyte to form said anode are performed substantially simultaneously by forming said alloy in said molten salt electrolyte.

10. The process as described in claim 1, wherein said cathode means includes a substantially planar surface for forming said silicon in substantially planar sheets.

11. The process as described in claim 1, wherein said cathode means comprises a substrate whereon said substantially pure silicon is formed, said substrate being adapted to readily release said silicon deposits upon removal of said cathode means from said electrolyte.

12. The process as described in claim 11, wherein said substrate comprises graphite.

13. The process as described in claim 1, wherein said electrolyte is purified by applying a reverse potential across said cathode means and anode to polarize said Cu/Si alloy cathodically, said reverse potential being of sufficient magnitude to substantially remove any dissolved metal oxides from said electrolyte.

14. The process as described in claim 1, wherein said potential is applied in variable amounts sufficient to maintain a constant current density in the range of about 25–200 $mA/cm^2$ to produce silicon deposits having grain sizes inversely proportional to said current density, said current density being maintained at a level below a maximum critical level about which said silicon is produced in dendritic form on said cathode means.

15. In an electrochemical cell for refining silicon including an anode containing unrefined silicon, said electrochemical cell being adapted to contain a dried molten salt electrolyte, and an electrically conductive cathode, said cathode being adapted to allow refined silicon to be deposited thereon, the improvement wherein said anode comprises a solid Cu/Si alloy, and said electrolyte is substantially free of dissolved metal oxides.

16. The improvement as described in claim 15, wherein said anode comprises a $Cu_{3+x}Si_{1-x}$ alloy, where x is less than about 0.1.

17. The improvement as described in claim 15, wherein said electrolyte comprises a mixture of molten salts containing $SiF_6^{-2}$ anions for transporting silicon from said anode to said cathode.

18. The improvement as described in claim 15, wherein said cathode includes a substantially planar surface for forming substantially planar sheets of refined silicon thereon.

19. An electrochemical process for producing substantially planar sheets of high purity silicon comprising:

forming a solid Cu/Si alloy anode;

positioning said anode in a dried, molten salt electrolyte maintained at a temperature below the eutectic temperature of said alloy;

placing an electrically conductive cathode in said electrolyte, said cathode having a substantially planar surface for plating of said high purity silicon;

purging said electrolyte of dissolved metal oxides; and applying an electrical potential between said anode and cathode sufficient to transport silicon from said anode to said cathode plating surface to form substantially dense, coherent sheets of high purity silicon on said cathode plating surface.

20. The process as described in claim 19, wherein said high purity silicon sheets are removed from said electrolyte and heated under a vacuum to remove residual electrolyte impurities therefrom.

21. The process as described in claim 19, wherein said cathode plating surface is adapted to prevent bonding of said silicon sheets thereto, thereby permitting ready removal of said sheets from said cathode.

22. The process as described in claim 19, wherein said cathode plating surface comprises a substrate material adapted for adhesion to said silicon sheets for use with said silicon.

23. The process as described in claim 19, wherein said electrical potential is varied to maintain a substantially constant current density between said anode and cathode below a critical current density level above which said high purity silicon is produced in dendritic form on said cathode, thereby favoring the formation of dense, coherent sheets of silicon.

24. A process for producing silicon comprising:

forming an alloy of Cu and Si;

forming a dry, molten salt electrolyte and wherein said steps of forming said electrolyte further comprise:

producing a molten mixture consisting of LiF and KF with an excess of KF therein, and exposing said molten LiF, KF mixture to $SiF_4$ gas so as to produce $K_2SiF_6$ in said molten LiF, KF mixture;

positioning said alloy in said electrolyte to form a solid Cu/Si anode structure therein;

placing electrically conductive cathode means within said electrolyte for plating silicon thereon;

purifying said electrolyte to remove dissolved oxides therefrom; and applying a potential between said anode and cathode means in an amount sufficient to form substantially pure silicon on said cathode means in the form of substantially dense, coherent deposits.

* * * * *